US007441361B2

(12) United States Patent
Rowan

(10) Patent No.: US 7,441,361 B2
(45) Date of Patent: Oct. 28, 2008

(54) LATTICE NETWORK DISPLAY DEVICE

(75) Inventor: Paul Rowan, Toronto (CA)

(73) Assignee: Umbra LLC, Buffalo, NY (US)

( * ) Notice: Subject to any disclaimer, the term of this patent is extended or adjusted under 35 U.S.C. 154(b) by 169 days.

(21) Appl. No.: 11/320,403

(22) Filed: Dec. 28, 2005

(65) Prior Publication Data

US 2007/0193098 A1 Aug. 23, 2007

(51) Int. Cl.
*A47G 1/16* (2006.01)

(52) U.S. Cl. ..... 40/743; 40/732; 40/768; 40/798; 40/735; D6/300

(58) Field of Classification Search ..... 40/700, 40/732, 768, 769, 772, 743, 800, 798, 737, 40/734, 771, 735, 790, 796; D6/300
See application file for complete search history.

(56) References Cited

U.S. PATENT DOCUMENTS

| | | | | | |
|---|---|---|---|---|---|
| D5,050 | S | | 6/1871 | Rice | |
| D9,732 | S | | 2/1877 | Gray | |
| 371,004 | A | * | 10/1887 | Tollner, Jr. | 40/768 |
| 975,094 | A | * | 11/1910 | Williams | 40/700 |
| 1,168,832 | A | * | 1/1916 | Smernoff | 40/790 |
| 1,649,415 | A | * | 11/1927 | Moseson | 40/765 |
| D104,593 | S | * | 5/1937 | Van Etten | D6/300 |
| D115,622 | S | | 7/1939 | Jewett | |
| D136,347 | S | | 9/1943 | Schenker | |
| 2,538,386 | A | | 1/1951 | Schneider | |
| D186,114 | S | * | 9/1959 | Church | D6/300 |
| D200,159 | S | | 1/1965 | Mueller | |
| 3,599,361 | A | * | 8/1971 | Bowman et al. | 40/711 |
| D230,238 | S | | 2/1974 | Coda | |
| D248,356 | S | | 7/1978 | Tougas et al. | |
| 4,310,976 | A | * | 1/1982 | Wilten | 40/737 |
| D334,478 | S | | 4/1993 | Rogers | |
| 5,199,200 | A | * | 4/1993 | Howell | 40/799 |
| D339,921 | S | | 10/1993 | Nourse | |
| D345,379 | S | | 3/1994 | Chan | |
| D355,769 | S | * | 2/1995 | Miles | D6/300 |
| D362,122 | S | | 9/1995 | Kong | |
| D369,679 | S | | 5/1996 | Langford | |
| D370,353 | S | | 6/1996 | Valls et al. | |
| D394,556 | S | | 5/1998 | Ricci | |
| 5,974,714 | A | * | 11/1999 | Jones | 40/768 |
| 6,108,958 | A | | 8/2000 | Kofoed | |
| 6,550,172 | B2 | * | 4/2003 | Korpai | 40/725 |
| D491,731 | S | | 6/2004 | Harwanko | |
| 2003/0121195 | A1 | | 7/2003 | Moon | |
| 2004/0216345 | A1 | | 11/2004 | Wadusky | |

* cited by examiner

*Primary Examiner*—Gary C Hoge
(74) *Attorney, Agent, or Firm*—Simpson & Simpson, PLLC

(57) ABSTRACT

The present invention is a display device configured to display sheet like materials such as photos, cards, pictures, patches, and the like. It includes an external frame with a double shoulder configuration in its internal perimeter, a lattice network formed into one or central display areas and supported by the front shoulder, and a transparent front facing a transparent rear facing supported by the rear shoulder. Display items are supported between the front facing and rear facing. Retainers of various types may be used to hold the components in place. Supports are described for mounting or otherwise displaying the display device of the present invention.

29 Claims, 9 Drawing Sheets

LATTICE NETWORK DISPLAY DEVICE

FIELD OF THE INVENTION

The invention relates generally to display devices, particularly to framed display devices, and more particularly to framed display devices having a lattice network.

BACKGROUND OF THE INVENTION

Framed display devices are well known globally. Frames provide a structure to art work by preventing the rolling or folding of a display item. They also provide a measure of protection from destruction by protecting the edges of items on display.

In addition, the structure and surface features of frames themselves may contribute to the appearance of a piece of work on display. There are numerous examples of decorative and artistic frames that are able to enhance the item or items displayed by a frame. For example, U.S. Pat. No. D9,732 to Gray discloses a frame in which the four sides are shaped into the form of vines. U.S. Pat. No. D248,356 to Tougas et al. discloses a frame in which each of its sides has a wicker-type configuration. U.S. Pat. No. D200,159 to Mueller, et al. discloses a frame with sides having a wavy configuration and also includes two diagonally crossed pieces in the rear.

One contemporary trend in artistic display is the presentation of "floating" displays in which the displayed item has the appearance of being suspended in space by being held by transparent facings. U.S. Patent Publication No. 2003/0121195 to Moon discloses such an artistic display system. U.S. Pat. No. D369,679 to Lankford is another example of picture holders designed to hold a floating display item.

What appears to be lacking in the field is a display device that combines the structural and artistic advantages of a frame with the capacity to support a floating display item. U.S. Patent Publication No. 2004/0216345 to Wadusky discloses a support frame having four corner mounting devices that support front and rear facings that hold one or more display items sandwiched between the two facings. However, the four mounting devices are only positioned at the four corners and do not extend along the length and width of the facings. U.S. Pat. No. 6,108,958 to Kofoed discloses a picture framing kit with a lattice system that sits behind a transparent facing within an exterior frame, but does not disclose any methods or components that would enable a floating display effect.

What is needed then is a device that would provide the structural and artistic advantages of an external frame while still giving display items a floating effect.

SUMMARY OF THE INVENTION

The present invention broadly comprises a display device including a frame having an inner perimeter and outer perimeter in which the inner perimeter is configured in the form of two shoulders, a lattice network formed from strips attached to the first or front of the two shoulders, the lattice network having at least one display area in which the display area is surrounded by some or all of the strips, a front facing fabricated from a transparent material and set into the second or rear shoulder, and a rear facing fabricated from a transparent material and positioned to rest on the front facing, and retaining means positioned to retain the front and rear facings. In a preferred embodiment, support means in functional association with the rear of the display device are provided to support the display device.

The present invention also includes an alternate embodiment in which the lattice network is formed into a plurality of display areas each of which is surrounded by some or all of the strips of the lattice network. This alternate embodiment includes a frame having an inner perimeter and outer perimeter in which the inner perimeter is configured in the form of two shoulders, a lattice network formed from strips attached to the first of the two shoulders, the lattice network having a plurality of display areas wherein each of the plurality of display areas is surrounded by some or all of the strips, a front facing fabricated from a transparent material and set into the second or rear shoulder, and a rear facing fabricated from a transparent material and positioned to rest on the front facing, and retaining means positioned to retain the front and rear facings. In a preferred embodiment, support means in functional association with the rear of the display device are provided to support the display device.

One object of the invention is to provide a framed structure that gives structural support and artistic effect to the invention.

A second object is to provide a device that allows for the presentation of display items using a floating effect.

A third object is to allow for the display of a plurality display areas within the display device.

An additional object is to provide a display device that enables the display of both framed and floating display items.

A further object is to provide a frame configured to provide sufficient support for the items held within the frame.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF THE INVENTION

At the outset, it should be appreciated that like drawing numbers on different drawing views identify identical structural elements of the invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Figure 1:
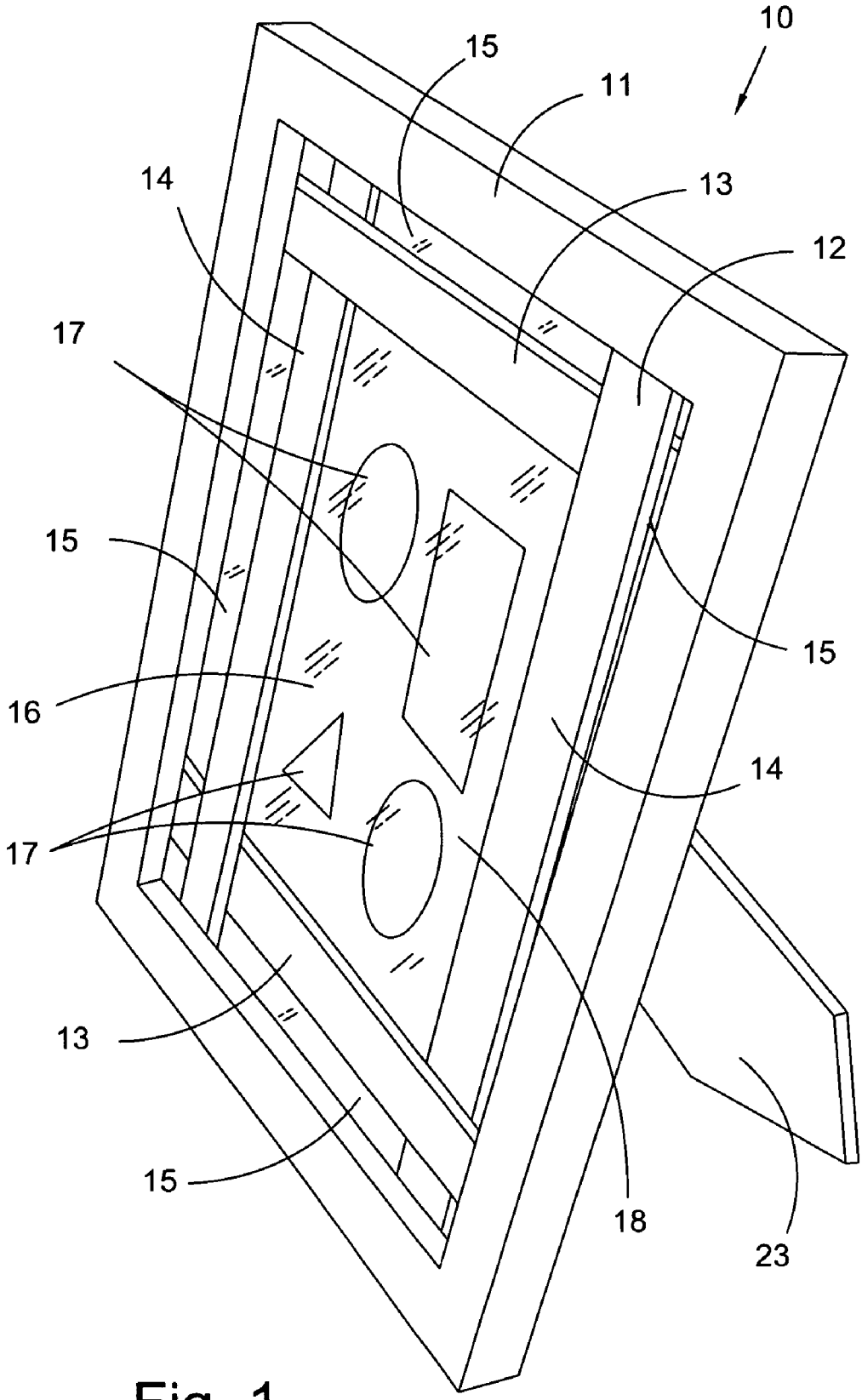
FIG. 1 is a front perspective view of a first embodiment of the present invention.

Adverting to the drawings, FIG. 1 is a front perspective view of one embodiment of display device 10. External frame 11 forms the perimeter of display device 10 and surrounds and supports the inner components of display device 10. Lattice network 12 is formed from longitudinal strips 14 extending along the length of frame 11 and transverse strips 13 extending along the width of frame 11. It will be recognized by those skilled in the art that lattice network 12 may contain more than one longitudinal strip 14 and or transverse strip 13 on each length and width, respectively, of frame 11 and that there may be different numbers of longitudinal strips 14 and transverse strips 13 on each length and width of frame 11. Gap 15 is shown between the inner perimeter of frame 11 and the outermost longitudinal strips 14 and transverse strips 13.

Figure 2:
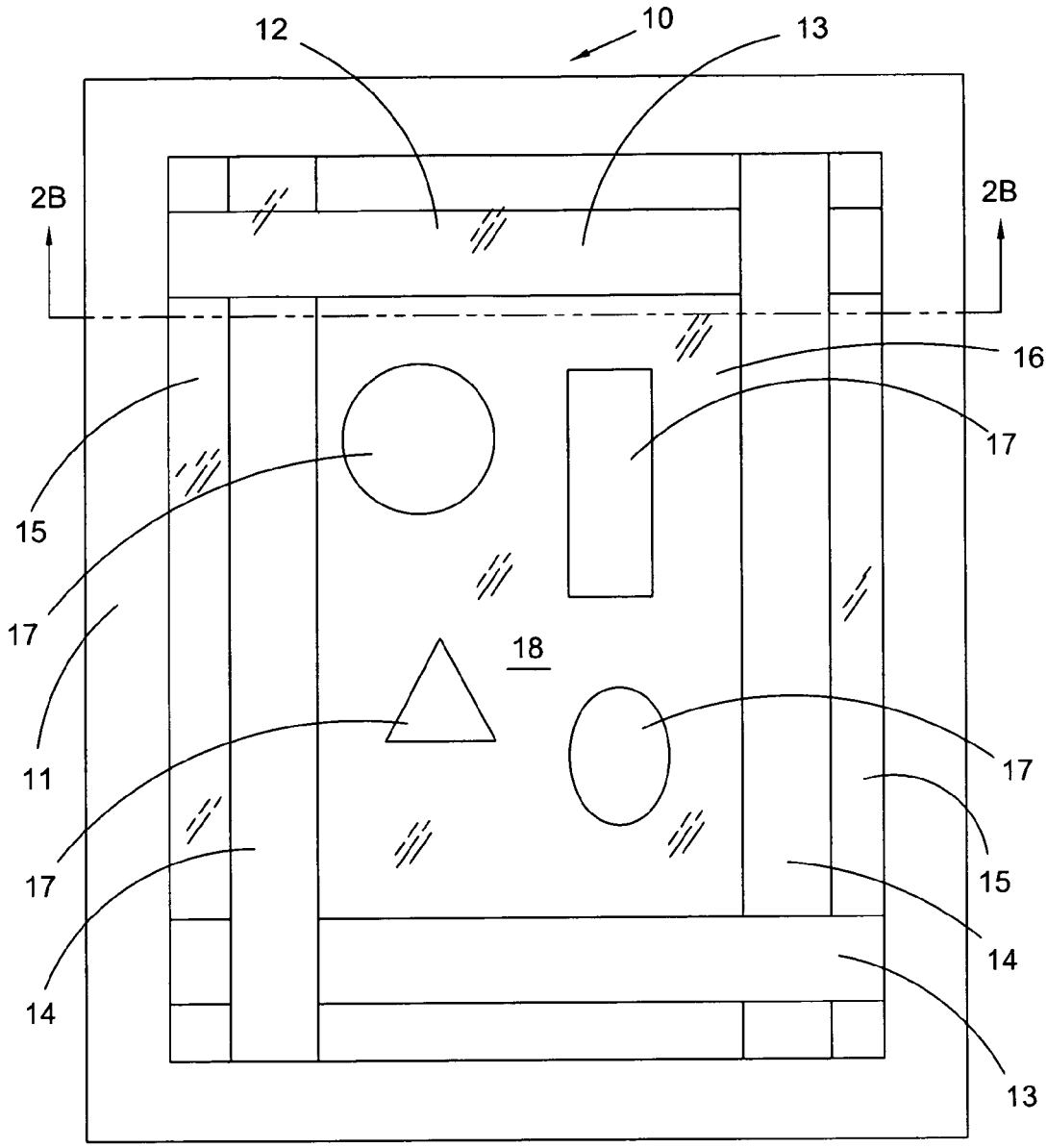
FIG. 2 is a front view of the first embodiment of the present invention.

Display area 16 is formed by the innermost transverse strips 13 and longitudinal strips 14. As will be discussed below, in an alternate embodiment, lattice network 12 may form more than one display area 16. Within display area 16, one or more display items 17 are presented. It will be recognized that display items 17 may be small enough to fit totally within the perimeter of display area 16, may be framed by the innermost strips of lattice network 12 or may extend beyond the strips of lattice network 12 bordering display area 16 into gap 15. Display items may be photographs, drawings, leaves, patches and/or other memorabilia sufficiently sized to fit within frame 11 as described below. In a preferred embodiment, support means 23, discussed below in detail, is shown and holds display device 10 in a sloping upright position. FIG. 2 is a front view of display device 10 more clearly showing front facing 18 which is a transparent sheet behind lattice network 12 covering display item(s) 17.

Figure 1A:
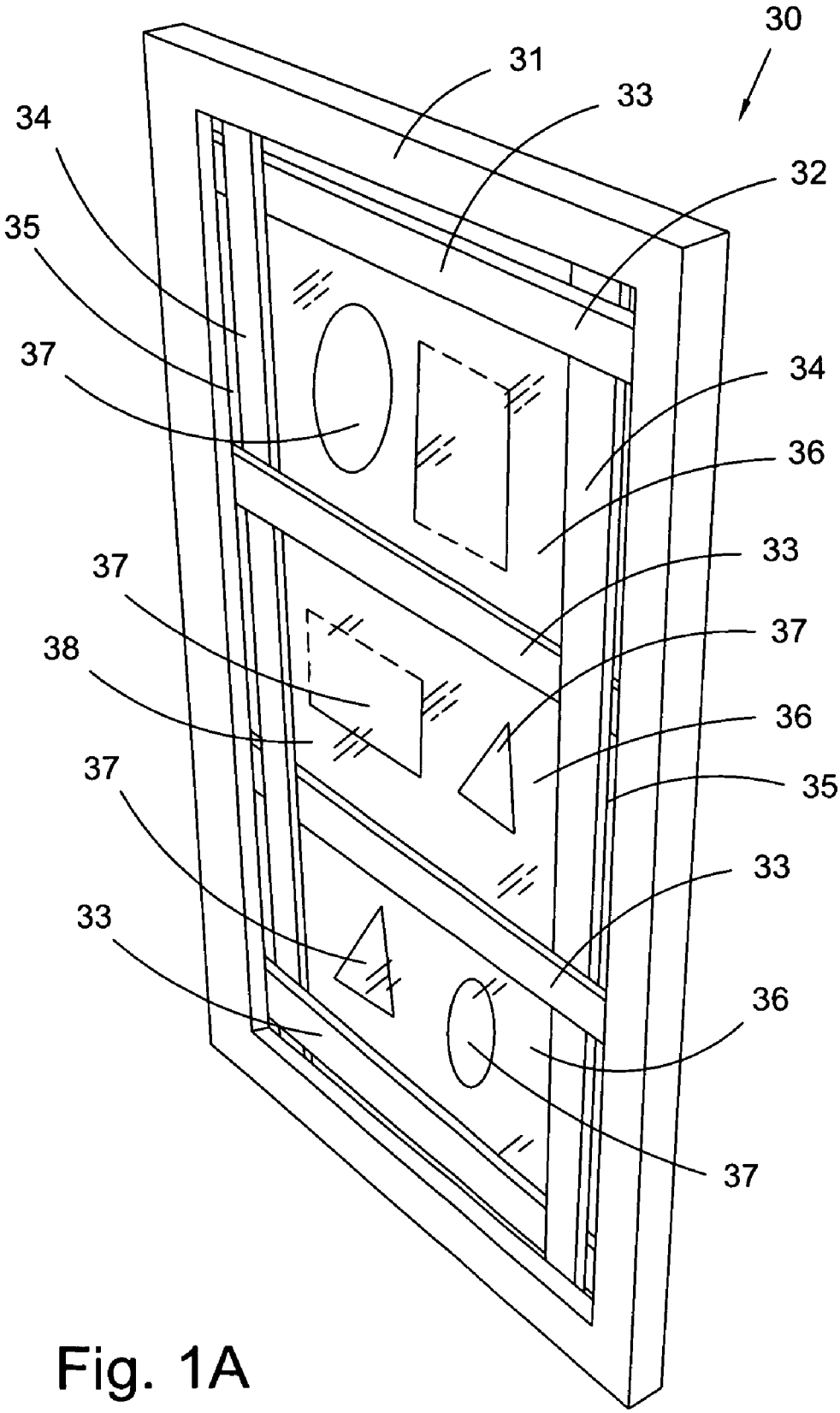
FIG. 1A is a front perspective view of a second embodiment of the present invention.

FIG. 1A is a front perspective view of multi-display device 30, an alternate embodiment of the present invention. As in display item 10, frame 31 encloses multi-display device 30 and supports the inner components of multi-display device 30. Lattice network 32 includes transverse strips 33 and longitudinal strips 34. There may be more than one longitudinal strip 34 along each length of frame 31 or more than one transverse strip 33 along the width of multi-display device 30. Multi-display device 30 includes sufficient transverse strips to form a plurality of display areas 36. Persons of skill in the art will recognize that a plurality of display areas 36 may be formed by sufficient numbers of longitudinal strips 34 as well as a combination of longitudinal strips 34 and transverse strips 33. As in display device 10 shown in FIG. 1, each of the display areas 36 is surrounded by transverse strips 33 and longitudinal strips 34. Gap 35 is formed between frame 31 and lattice network 32. Display items 37 are seen in each of display areas 36. FIG. 2A is a front view of multi-display device 30 more clearly showing front transparent facing 38 behind lattice network 32 covering the front side of display item(s) 37.

Figure 2B:
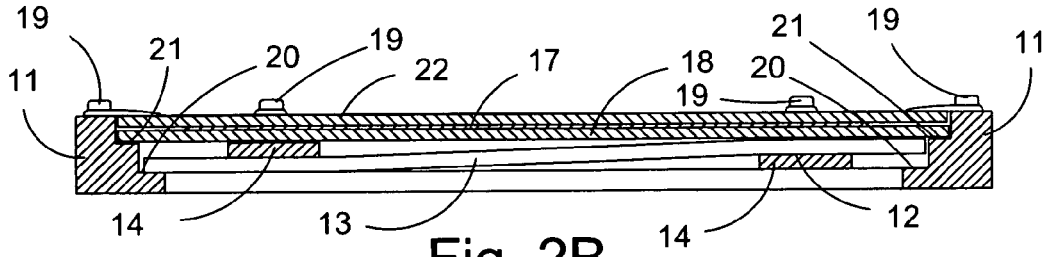
FIG. 2B is a cross section view of the first embodiment of the present invention taken along line 2B-2B of FIG. 2.
Figure 2A:
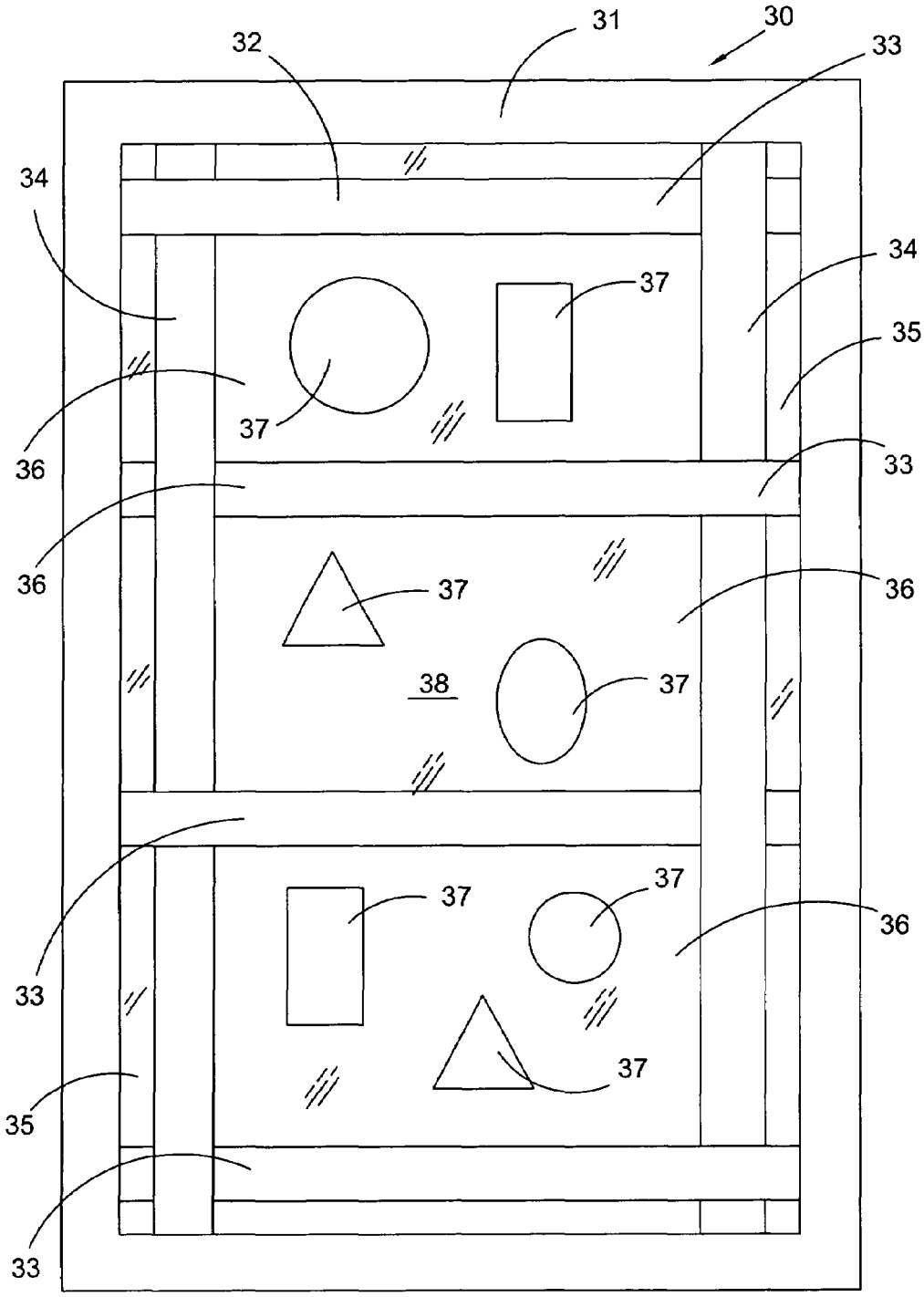
FIG. 2A is a front view of the second embodiment of the present invention.
Figure 2C:
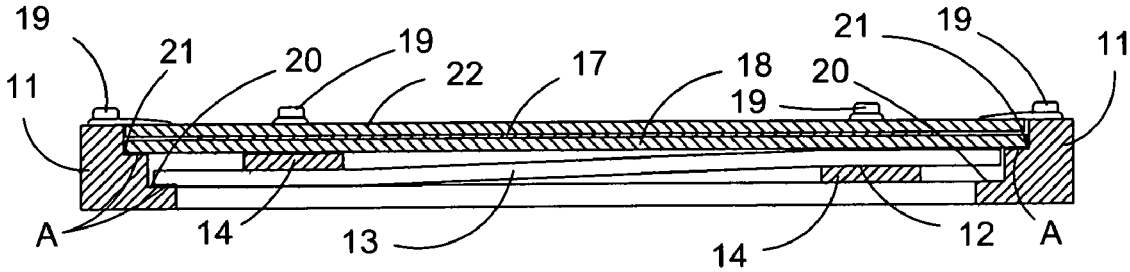
FIG. 2C is a cross section view similar to that of FIG. 2B depicting the use of adhesives to retain the front latticework.

FIG. 2B is a cross section view of display item 10 taken along line 2B-2B of FIG. 2. Frame 11 includes a double shoulder configuration along its inner perimeter which provides two shelf-like projections around the inner perimeter. Front shoulder 20 is seen as supporting transverse strip 13 of lattice network 12. Not seen in this view, first shoulder 20 also supports longitudinal strips 14 in the same manner as transverse strips 13. In the embodiment shown, lattice network 12 is removably supported by front shoulder 20. In an alternate embodiment, lattice network 12 is retained on front shoulder 20 by adhesive A. Rear shoulder 21 holds front facing 18 and transparent rear facing 22. Display item(s) 17 are held between front facing 18 and rear facing 22 in a sandwich type configuration. The support of front facing 18 and rear facing 22 by rear shoulder 21 enables the presentation of display items 17 to achieve a "floating effect" by supporting the display item(s) 17 with the facings in a "sandwich" tight enough to render them immobile without having them appearing to be supported by lattice network 12 or frame 11. Front shoulder 20 and rear shoulder 21 are seen to project from the inner perimeter at substantially right angles. The double shoulder configuration enables the load of lattice network 12, front facing 18, and rear facing 22, along with any display item(s) 17 to be distributed over the entire thickness of the interior perimeter of frame 11 giving increased support to each of those elements. In one embodiment, front facing 18 may be removably supported by rear shoulder 21. In an alternate embodiment, front facing 18 may be attached to rear shoulder 21 by adhesive A as seen in FIG. 2C. Similarly, rear facing 22 may be removably mounted into rear shoulder 21 or attached to rear shoulder 21 using an adhesive. Using a similar double shoulder configuration as described above in the inner perimeter of frame 31 of multi-display 30 (not shown in FIG. 2B), substantially the same support can be realized for display item(s) 37 placed between front facing 38 and rear facing 42.

In a more preferred embodiment, the distance between front shoulder 20 and rear shoulder 21 is evaluated to allow enough room to hold lattice network 12 without disturbing support front facing 18, display items 17, and rear facing 22 supported by rear shoulder 21 to prevent display items from moving. Front facing 38 and rear facing 42 may be retained in a removable or attached embodiment as described above with display device 10.

Figure 3:
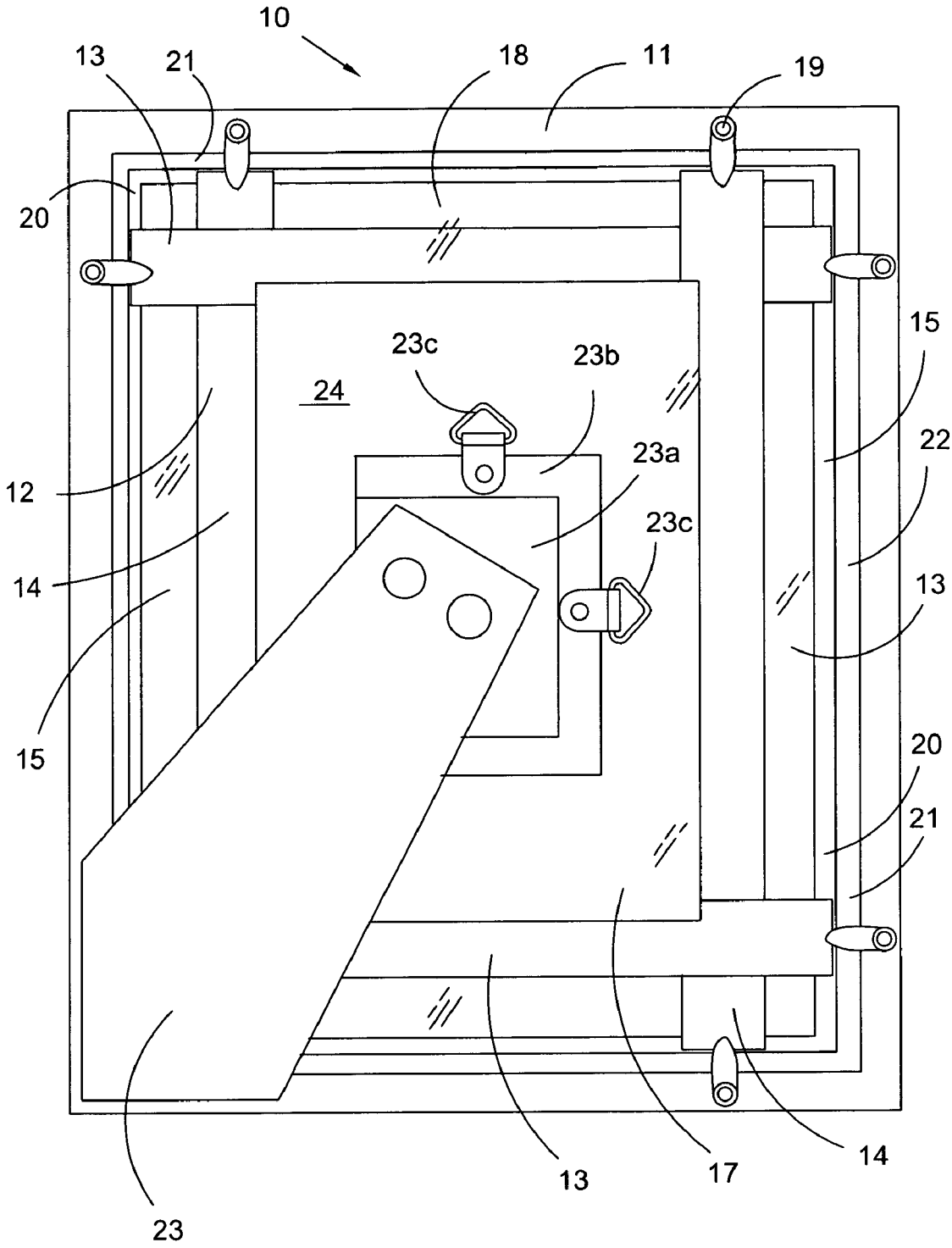
FIG. 3 is a rear view of the first embodiment of the present invention.

FIG. 3 is a rear view of display device 10 showing one embodiment of retaining means 19. In the embodiment shown, retaining means 19 are swivel pins attached to frame 11 and that rotate to extend over rear facing 22 to retain lattice network 12 in place against front shoulder 20 and front facing 18, display item 17 and rear facing 22 against rear shoulder 21. By retaining means is meant devices that extend over rear facing 22 to hold the above elements in place. Other retaining means include stays such as brads, pins, staples, nails, or other similar devices that extend from frame 11 over rear facing 22 to hold in place the components resting on shoulders 20 and 21. FIG. 3B depicts an example of the use of stays in the form of staple 19*a*. In an alternate embodiment, retaining means may include adhesives that hold some or all of the above components in place on shoulders 20 and 21. Retaining means may be located within the inner perimeter of frame 11 and/or on the rear of frame 11 as shown in FIGS. 2 and 2A.

FIG. 3 also shows two embodiments of support means 23 which are defined as devices used to support the entire display device 10 or multi-display device 30. Support means 23 are in functional association with the rear of display device 10 or multi-display device 30 meaning that they are attached to one or more components of the rear side of either display device 10 or multi-display device 30 to support those devices. In FIG. 3, support means 23 is a prop hingably attached to slide 23*a* which slides into block 23*b*. Block 23*b* is attached to rear facing 22 and is shaped to receive slide 23*a* by creating a cutout of the block sized to receive slide 23*a*. In a preferred embodiment, slide 23*a* is sized to be inserted into the cutout to enable display device 10 to be propped on either the long or short side of frame 11. FIG. 3 also depicts rings 23*c* as an alternate embodiment to support means 23 which allows display device 10 to be mounted on a wall or similar support. In the preferred embodiment shown, rings 23*c* are positioned to allow display device 10 to be supported in a longitudinal (long side) or transverse (width) position. FIG. 3 also depicts the embodiment in which the perimeter of display item 17 extends into longitudinal strips 12 and transverse strips 13 surrounding display area 16 to frame display item 17. Other examples of support means 23 include hanger style devices such as hook and wire assemblies, eyelet hangers, suction devices and other equivalent objects designed to hold display device 10 and multi-display device 30 in place.

Figure 3A:
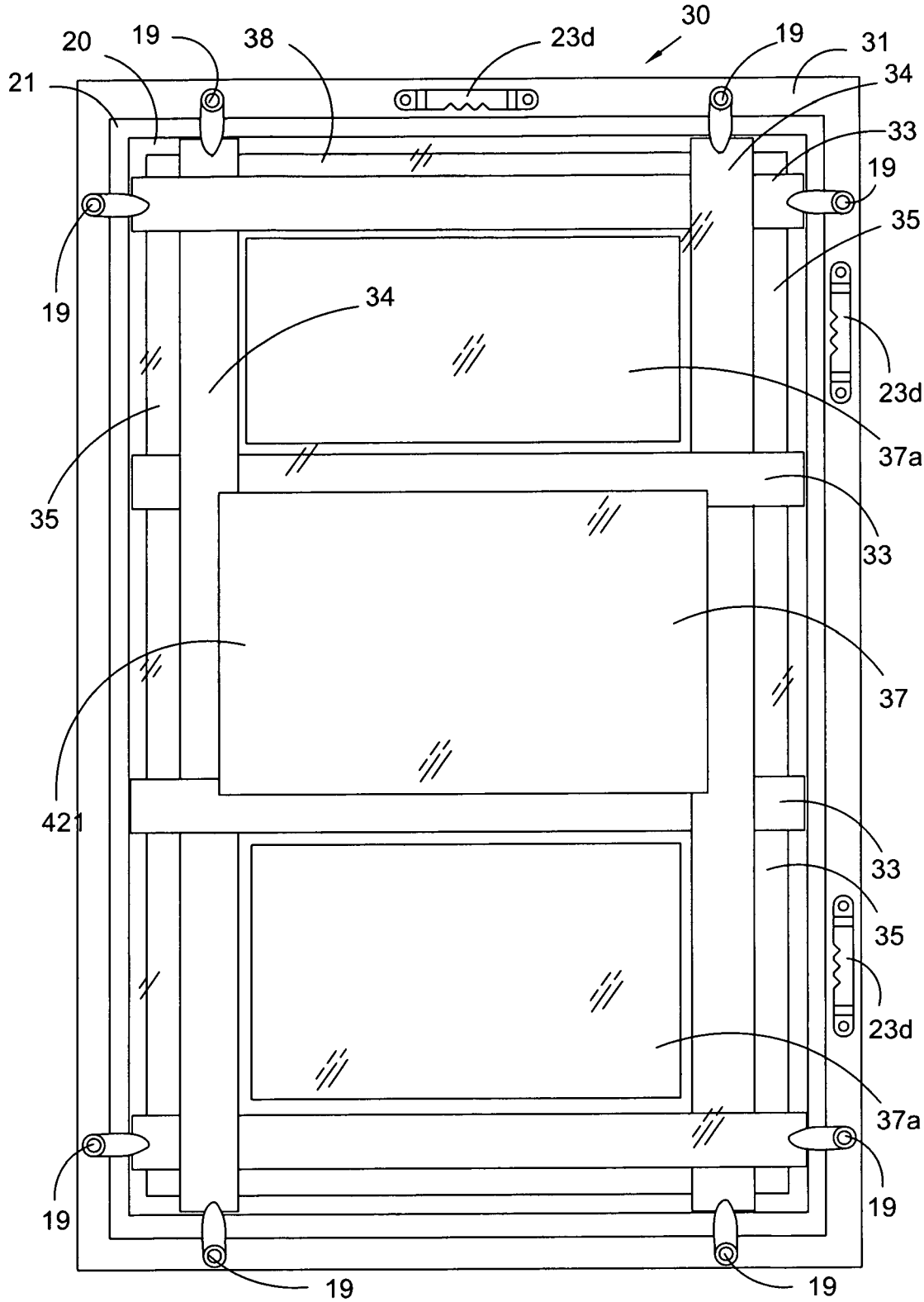
FIG. 3A is a rear view of the second embodiment of the present invention.
Figure 3B:
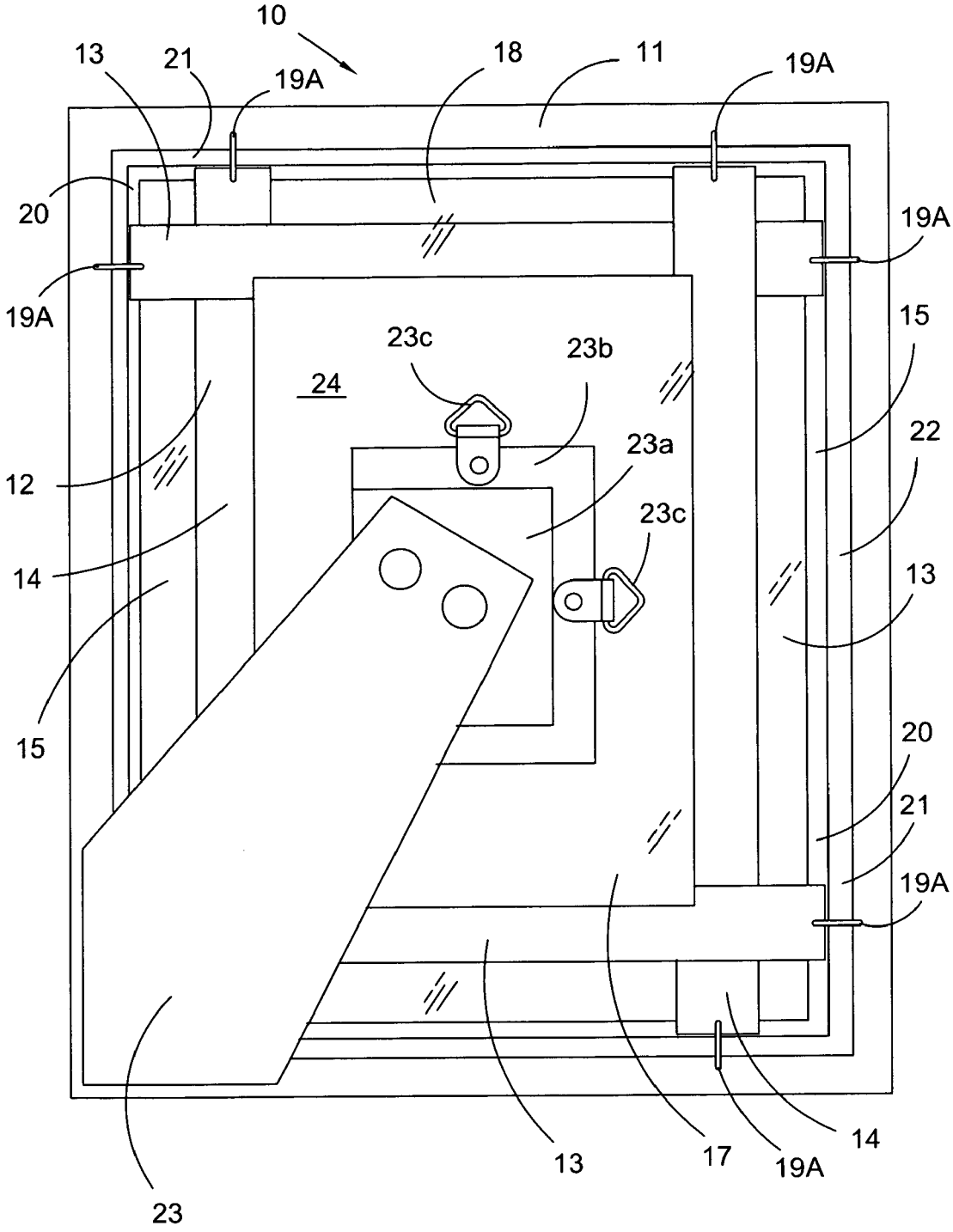
FIG. 3B is a rear view of the first embodiment of the present invention depicting the use of stays as retaining means; and, FIG. 4 is an exploded perspective view of the first embodiment of the present invention.

FIG. 3A is a rear view of multi-display device 30. In still another embodiment of support means 23, support means 23*d* shown in the form of sawtooth supports are seen attached to frame 31. Also seen is display item(s) 37 positioned over display areas 36 so as to extend into transverse strips 33 and longitudinal strips 34 to give a framed appearance by the strips surrounding that display area 36. Also seen in FIG. 3A is an alternate embodiment in which display items 37*a* are wholly within upper and lower display areas 36 to create a floating effect. It will be recognized that one or more of display areas 36 may have floating display items 37*a* while simultaneously other display areas 36 may have display items 37 positioned to extend into or beyond the surrounding lattice network strips.

Figure 4:
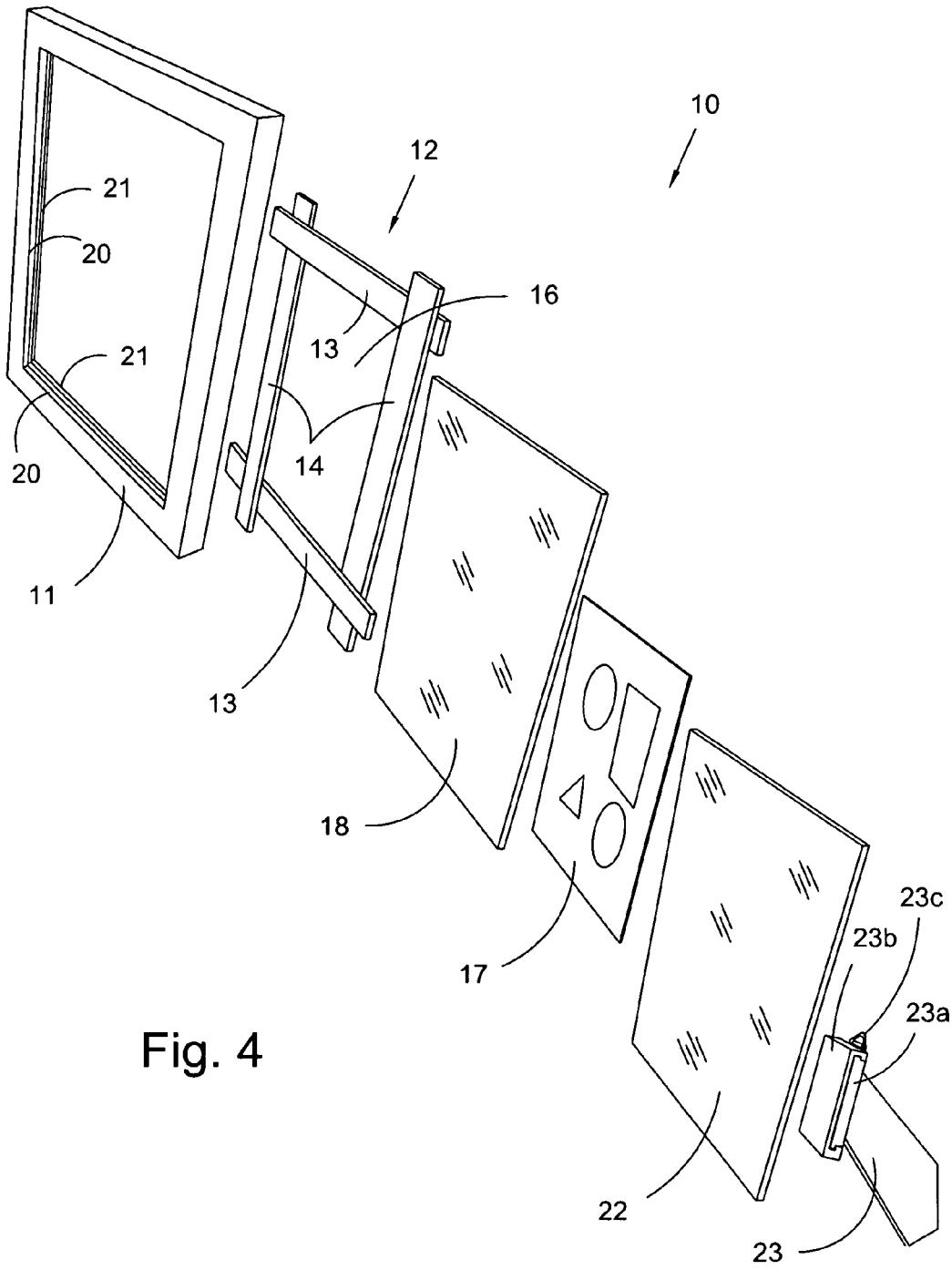

FIG. 4 is an exploded perspective view of display device 10. In the embodiment shown, lattice network 12 is placed onto front shoulder 20. Front facing 18 is positioned onto rear shoulder 21. Display item(s) 17 is positioned within display area 16 or if desired, placed within or extended over the strips of lattice network 12. Rear facing 22 is positioned onto rear shoulder 21 over display item(s) 17 onto rear shoulder 21 and retaining means 19 (not shown) moved or positioned to extend over rear facing 22 to hold all the components in place. Finally slide 23*a* of support means 23, in this case a prop, is slid into block 23*b* which is attached to rear facing 22. A similar layering procedure is used for multi-display device 30. As discussed above, other retaining means 19 and support means 23 may be used.

Thus it is seen that the objects of the invention are efficiently obtained, although changes and modifications to the invention should be readily apparent to those having ordinary skill in the art, which changes would not depart from the spirit and scope of the invention as claimed.

I claim:

1. A display device comprising:

a frame having an inner perimeter and outer perimeter wherein said inner perimeter is configured in the form of two rigid shoulders, wherein each of said two shoulders form a substantially right angle with said inner perimeter;

a lattice network formed from strips attached to the first of said two shoulders, said lattice network having at least one display area wherein said at least one display area is surrounded by some or all of said strips;

a front facing fabricated from a transparent material and set into said second shoulder;

a rear facing fabricated from a transparent material and set into said second shoulder; and, retaining means positioned on said frame to retain said front and rear facings.

2. The display device as recited in claim 1 further comprising support means in functional association with the rear of said display device to support said display device.

3. The display device as recited in claim 1 wherein said at least one display area comprises a plurality of display areas.

4. The display device as recited in claim 1 wherein at least one part of each said front and rear facings are visible between said lattice network and said inner perimeter.

5. The display device as recited in claim 1 further comprising at least one display item positioned in said at least one display area between said front and rear facings.

6. The display device as recited in claim 5 wherein the perimeter of said at least one display item is covered by some or all of said surrounding strips.

7. The display device as recited in claim 5 wherein the perimeter of said at least one display item is enclosed within said at least one display area.

8. The display device as recited in claim 7 wherein a plurality of said at least one display items is enclosed within at least one of said at least one display areas.

9. The display device as recited in claim 1 wherein said retaining means are swivel retaining pins.

10. The display device as recited in claim 1 wherein said retaining means are stays.

11. The display device as recited in claim 1 wherein said retaining means is an adhesive.

12. The display device as recited in claim 2 wherein said support means is a prop positioned to hold said frame in a sloping position.

13. The display device as recited in claim 2 wherein said support means is an enclosed mounting device in functional association with said rear of said display device.

14. The display device as recited in claim 2 wherein said support means is a hanging device attached in functional association with said rear of said display.

15. The display device as recited in claim 14 wherein said hanging device is a sawtooth hanger.

16. A display device comprising:

a frame having an inner perimeter and outer perimeter wherein said inner perimeter is configured in the form of two shoulders;

a lattice network formed from strips attached to the first of said two shoulders, said lattice network having a plurality of display areas wherein each of said plurality of display areas is surrounded by some or all of said strips;

a transparent front facing set into said second shoulder;

a transparent rear facing positioned to rest on said front facing; and, retaining means positioned to retain said front and rear facings on said second shoulder.

17. The display device as recited in claim 16 further comprising support means in functional association with the rear of said display device to support said display device.

18. The display device as recited in claim 16 wherein at least one part of each of said front and rear facings are visible between said lattice network and said inner perimeter.

19. The display device as recited in claim 16 further comprising at least one display item positioned in at least one of said plurality of display areas between said front and rear facings.

20. The display device as recited in claim 19 wherein the perimeter of said at least one display item is covered by said surrounding strips.

21. The display device as recited in claim 19 wherein the perimeter of said at least one display item is enclosed within said at least one display area.

22. The display device as recited in claim 21 wherein a plurality of said at least one display items is enclosed within at least one of said at least one display areas.

23. The display device as recited in claim 16 wherein said retaining means are swivel retaining pins.

24. The display device as recited in claim 16 wherein said retaining means are stays.

25. The display device as recited in claim 16 wherein said retaining means is an adhesive.

26. The display device as recited in claim 17 wherein said support means is a prop positioned to hold said frame in a sloping position.

27. The display device as recited in claim 17 wherein said support means is an enclosed mounting device in functional association with said rear of said display device.

28. The display device as recited in claim 17 wherein said support means is a hanging device.

29. The display device as recited in claim 28 wherein said hanging device is a sawtoothed strip attached in functional association with said rear of said display.

* * * * *